US008695860B2

(12) United States Patent
Wang et al.

(10) Patent No.: US 8,695,860 B2
(45) Date of Patent: Apr. 15, 2014

(54) NAIL GUIDING STRUCTURE AND NAIL GUN COMPRISING THE SAME

(75) Inventors: Jing-Li Wang, Taichung Hsien (TW); Rong-Yu Wang, Taichung Hsien (TW)

(73) Assignee: Apex Mfg. Co., Ltd., Taichung Hsien (TW)

( * ) Notice: Subject to any disclaimer, the term of this patent is extended or adjusted under 35 U.S.C. 154(b) by 485 days.

(21) Appl. No.: 13/160,739

(22) Filed: Jun. 15, 2011

(65) Prior Publication Data

US 2012/0286018 A1 Nov. 15, 2012

(30) Foreign Application Priority Data

May 10, 2011 (TW) ..... 100116284 A

(51) Int. Cl.
*B25C 3/00* (2006.01)

(52) U.S. Cl.
USPC ..... 227/8; 227/109; 227/119; 227/120; 227/132

(58) Field of Classification Search
USPC ..... 227/8, 109, 119, 120, 132, 134, 138, 227/123
See application file for complete search history.

(56) References Cited

U.S. PATENT DOCUMENTS 5,180,091 A * 1/1993 Ota ..... 227/8
5,522,533 A * 6/1996 Mukoyama et al. ..... 227/109
5,692,665 A 12/1997 Lee
5,873,509 A * 2/1999 Liao ..... 227/109
6,076,720 A * 6/2000 Deng ..... 227/109
6,564,985 B1 * 5/2003 Chou ..... 227/109
6,644,530 B2 * 11/2003 Chen ..... 227/109
6,695,197 B2 * 2/2004 Johansson ..... 227/138
6,851,594 B1 * 2/2005 Huang ..... 227/109
6,938,813 B1 * 9/2005 Chen ..... 227/120
7,048,169 B2 * 5/2006 Sun ..... 227/120
7,520,413 B1 * 4/2009 Cho et al. ..... 227/109
7,617,958 B2 * 11/2009 Pozzato ..... 227/109

* cited by examiner

*Primary Examiner* — Scott A. Smith

(74) *Attorney, Agent, or Firm* — Muncy, Geissler, Olds & Lowe, P.C.

(57) ABSTRACT

A nail guiding structure of the present invention is disposed inside of the nail gun having a nail rail. The nail guiding structure includes one or more supporting members and a holding mechanism. The supporting member can move between a first and a second position, wherein the supporting member can move toward the first position to elastically push nails in the air gun, so that the nails can be vertically held in front of the nail rail. The holding mechanism can selectively hold the supporting member, so that the supporting cannot move back to the second position. Thereby, a user can move the holding mechanism to adapt for different thicknesses of nails. Only one nail can move to the front of the nail rail every time when a punching board of the nail gun punches. Consequently, the problems of nail jamming or crookedly stapling are prevented.

12 Claims, 9 Drawing Sheets

NAIL GUIDING STRUCTURE AND NAIL GUN COMPRISING THE SAME

BACKGROUND OF THE INVENTION

1. Field of the Invention

The present invention relates to a nail guiding structure and a nail gun having the nail guiding structure.

2. Description of the Prior Art

A nail gun projects out nails with its punching board. And a nail guiding structure may be disposed in front of a nail rail of the nail gun so as to hold nails on the nail rail and avoid nails from being stuck in the nail gun.

A nail guiding structure is disclosed in U.S. Pat. No. 5,692,665, wherein the FIG. 1 of said patent shows the extension parts 8, 9 can selectively pivot to the front of its nail rail and abut against nails so as to hold the nails. And its FIG. 3 further discloses that guiding parts 52, 62 are pivoted with a shaft 33, and the flexible base element 70 pushes the guiding parts 52, 62 to pivot toward the nail rail.

However, the nail guiding structure of said patent is only available for one thickness of nails. If a user loads thinner nails into the nail gun, two nails might be disposed in front of the nail rail, so that its punching board will punch two nails in the same time, and the nails will be crooked, deformed or even stuck in the nail gun.

Therefore, the present invention is arisen to obviate or at least mitigate the above mentioned disadvantages.

SUMMARY OF THE INVENTION

The main object of the present invention is to provide a nail guiding structure for different thicknesses of nails.

To achieve the above and other objects, a nail guiding structure of the present invention is adapted to be disposed inside a nail gun which has a nail rail, and the nail guiding structure is adapted to be disposed in front of the nail rail. The nail guiding structure includes a guiding panel, at least one supporting member, at least one pushing means and at least one holding means.

The guiding panel is vertically disposed in front of the nail rail. The guiding panel has a first surface and a second surface opposite to the first surface. The first surface faces toward the nail rail, and the guiding panel is formed with at least one positioning slot. The positioning slot is concavely formed on the first surface of the guiding panel.

The supporting member corresponds to the positioning slot and is slidably disposed in the positioning slot so that the supporting member can slide between a first position and a second position. The supporting member has a supporting end and a pushing end. The supporting end protrudes out of the first surface when the supporting member is located in the first position. The supporting end approaches the first surface when the supporting member moves toward the second position. The pushing means is adapted to elastically push the pushing end, so that the supporting member has a tendency to move to the first position. The holding means is adapted to selectively hold the supporting member, so that the supporting member is stopped from moving to the second position.

Thereby, the supporting member of the present invention can keep the nails vertically disposed before being punched out by the punching board of the nail gun. The holding means can selectively hold the supporting member, so that the supporting member can slide back to the second position or other position before reaching the second position when the nails abut against the supporting member. Consequently, the supporting member can be abutted against by different thicknesses of nails, and make the punching board punch one nail each time in order to prevent the nails from being crooked or stuck in punching movement.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
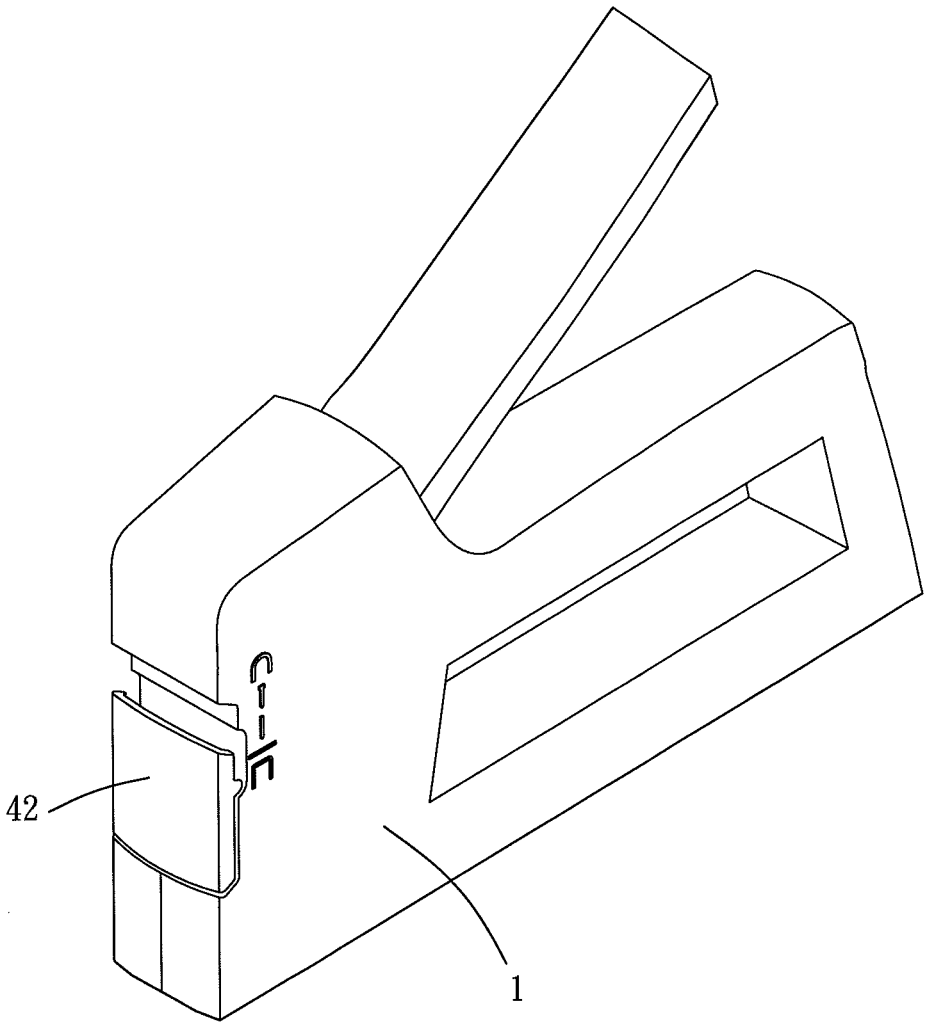
FIG. 1 is a stereogram showing a nail gun comprising a preferred embodiment of a nail guiding structure in accordance with the present invention.
Figures 2, 2A:
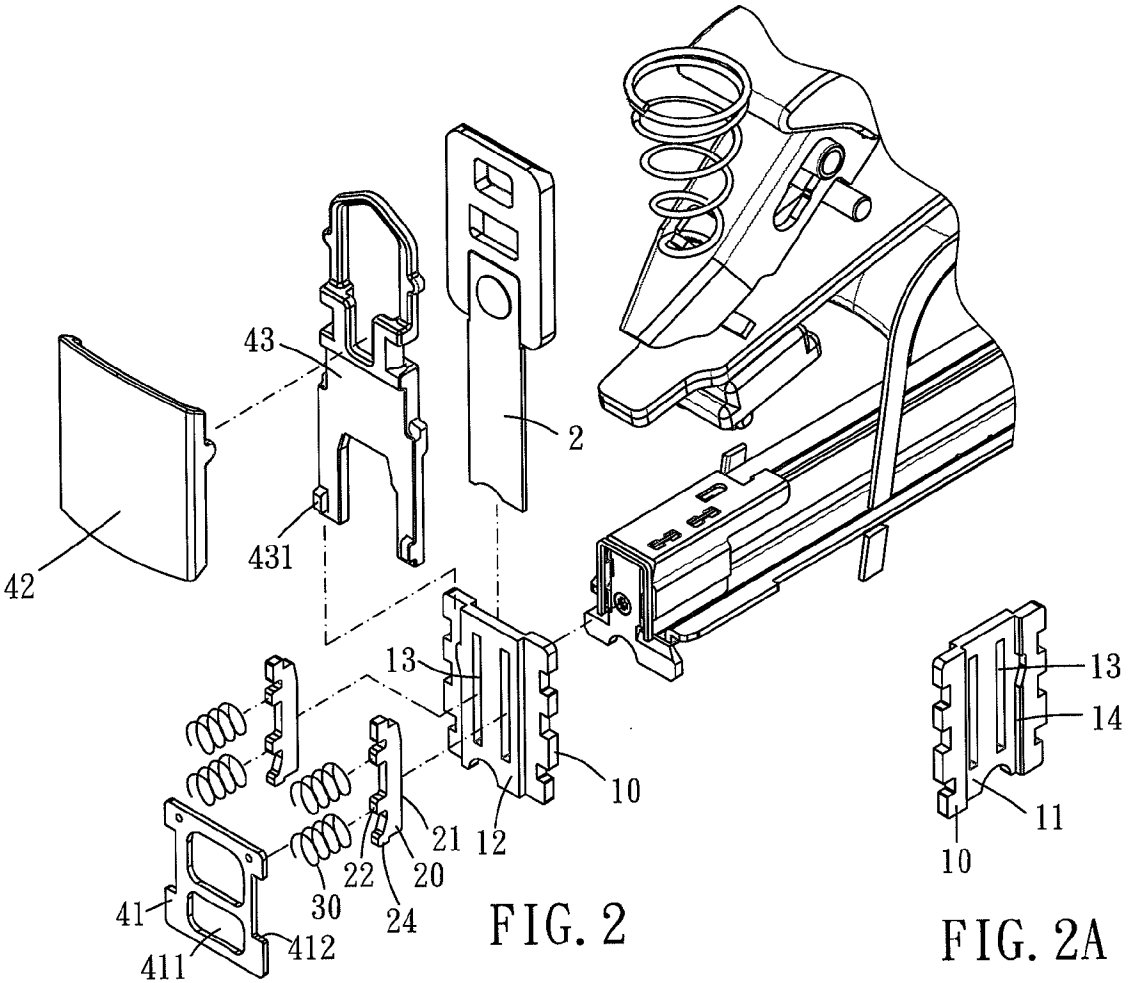
FIG. 2 is a breakdown drawing showing part of the FIG. 1.
FIG. 2A is a stereogram showing the guiding panel of a preferred embodiment of a nail guiding structure in accordance with the present invention.
Figure 3:
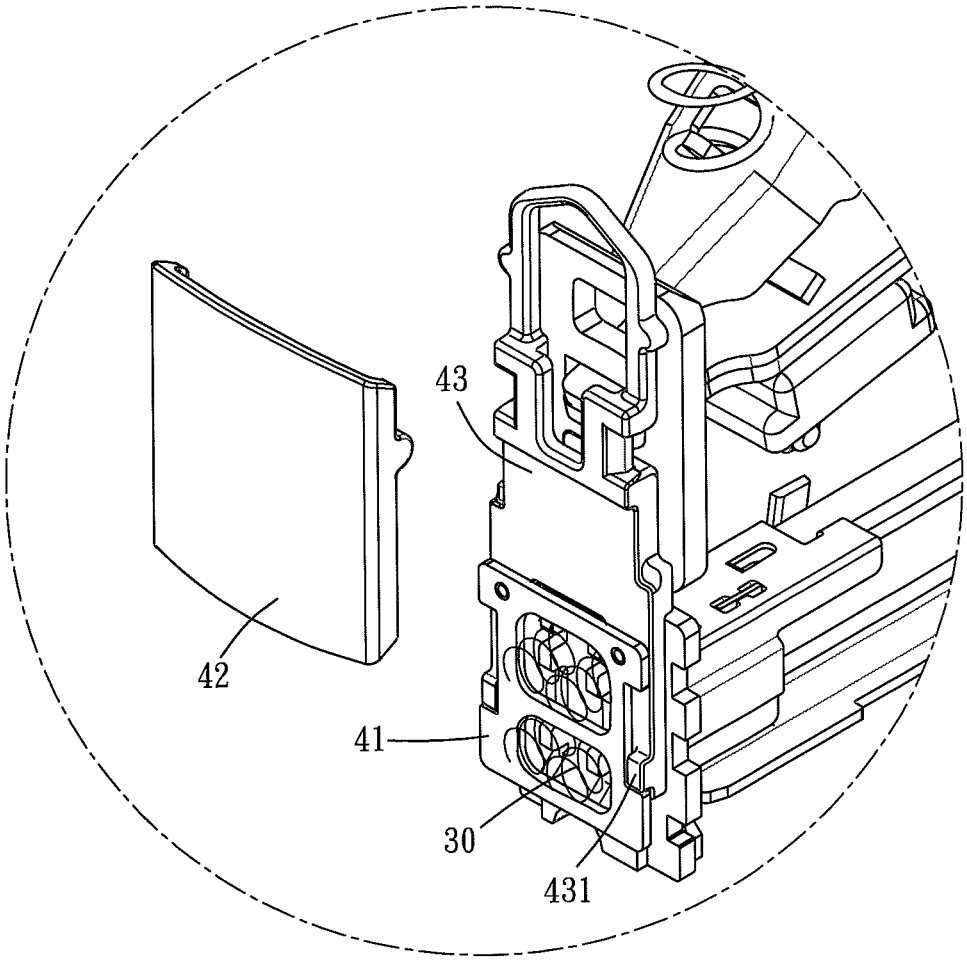
FIG. 3 is a stereogram showing part of the FIG. 1.
Figure 4:
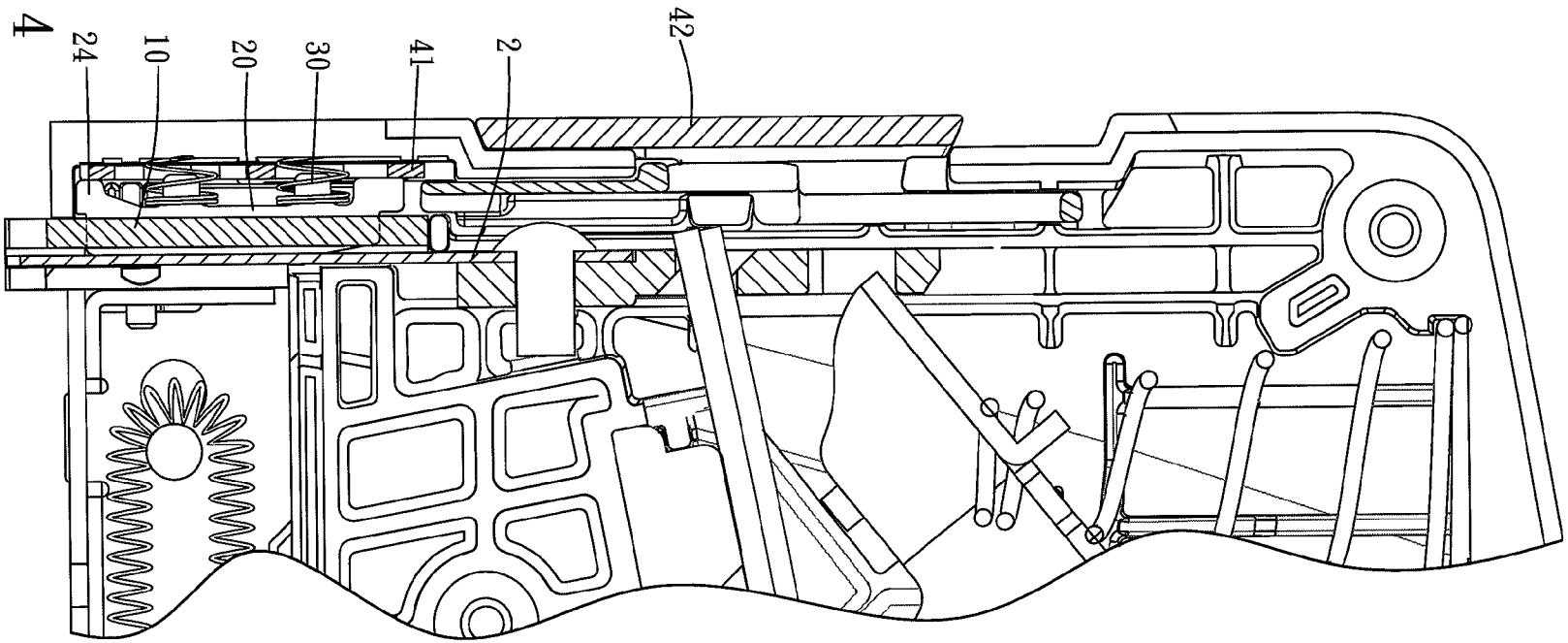
FIG. 4 is a sectional drawing showing part of the FIG. 1.

Please refer to FIGS. 1 to 4, the present invention provides a nail guiding structure for being disposed inside of a nail gun which has a nail rail. The nail guiding structure is adapted to be disposed in front of the nail rail. The nail guiding structure includes a guiding panel 10, at least one supporting member 20, at least one pushing means, and at least one holding means.

The guiding panel 10 is vertically disposed in front of the nail rail, and the guiding panel 10 has a first surface 11 and a second surface 12 opposite to the first surface 11. The first surface 11 faces the nail rail, and the guiding panel 10 is formed with at least one positioning slot 13 (there are two positioning slots in this embodiment). The positioning slot 13 passes through the first surface 11 and the second surface 12 of the guiding panel 10. Preferably, the first surface 11 of the guiding panel is formed with a guiding groove 14 which extends vertically. The guiding groove 14 is adapted to guide a punching board 2 or a nail to slide straightly along the guiding groove 14.

Figure 6:
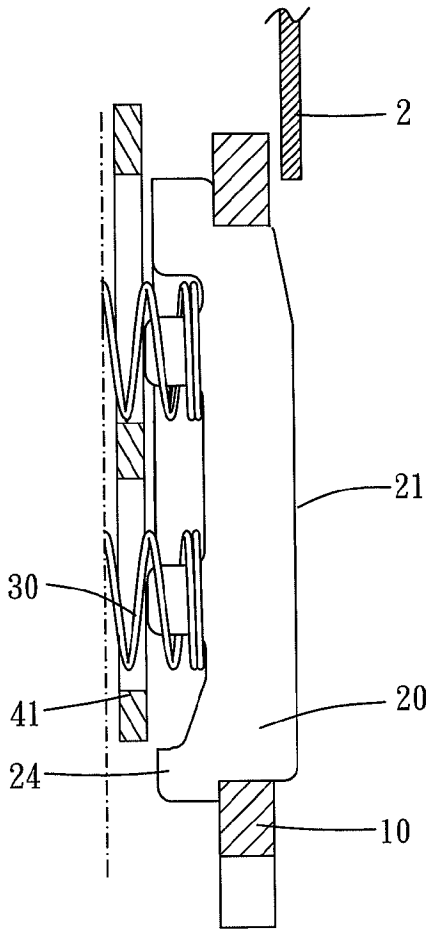
FIGS. 5-9 are schematic drawings showing the use of a preferred embodiment of a nail guiding structure in accordance with the present invention.
Figure 5:
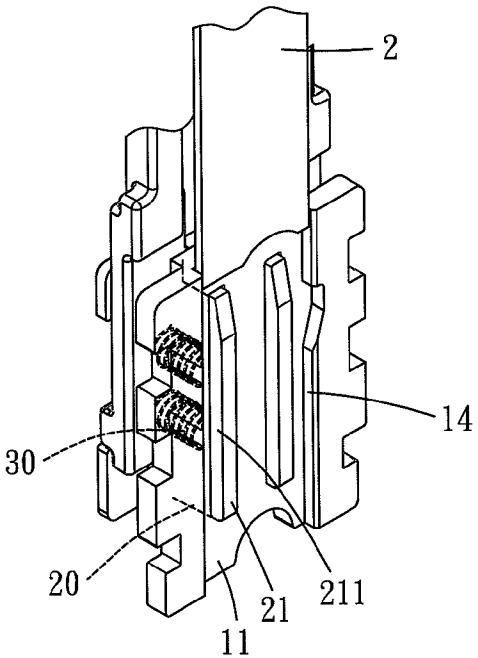
Figure 8:
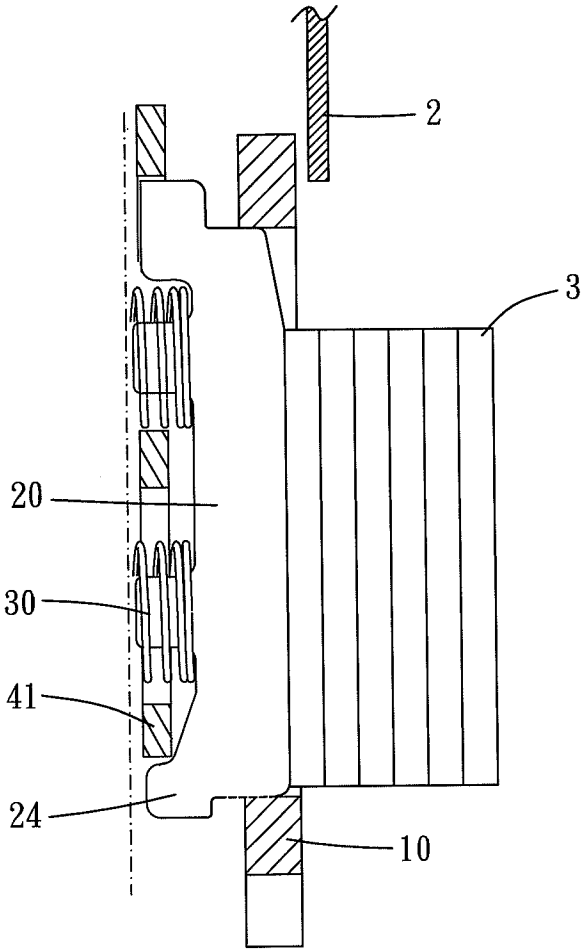
Figure 7:
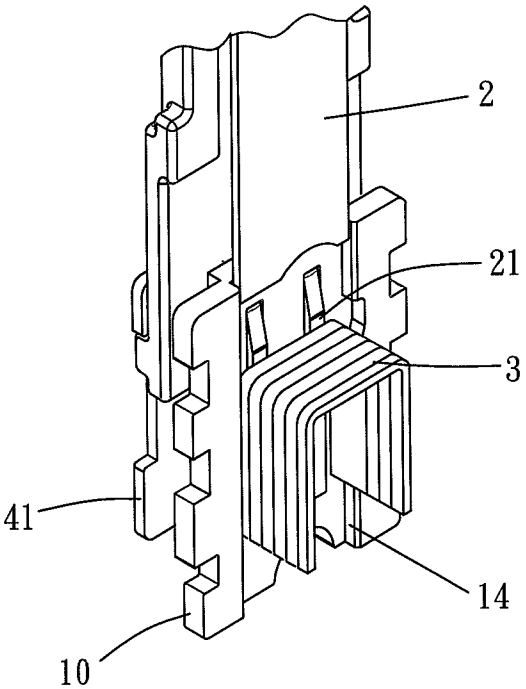

The supporting member 20 is formed corresponding to the quantity of the positioning slot 13, and the supporting member 20 is slidably disposed in the positioning slot 13, so that the supporting member 20 can slide between a first position, as shown in the FIGS. 5 and 6, and a second position, as shown in the FIGS. 7 and 8. The supporting member 20 has a supporting end 21 and a pushing end 22, as shown in FIG. 5. The supporting end 21 protrudes out of the first surface 11 when the supporting member 20 is located in the first position. The supporting end 21 approaches the first surface 11 when the supporting member 20 moves toward the second position. Preferably, the supporting end 21 is even with the first surface 11, and the pushing end 22 protrudes out of the second surface 12. To be specific, the supporting member 20 has a supporting surface 211 on two sides of the supporting end 21, and the supporting surface 211 extends out of the first surface 11. Thereby, the supporting surface 211 is parallel to the extending direction of the nail rail or the guiding groove so as to hold nails in the nail gun.

The pushing means is adapted to elastically push the pushing end 22, so that the supporting member has a tendency to move to the first position. In this embodiment, the pushing means includes at least one pair of elastic members 30 corresponding to the supporting member 20. The pair of the elastic members 30 respectively pushes two corresponding sides of the supporting member 20. Thereby, the supporting member 20 can be pushed with balanced forces so as to move smoothly and horizontally. Preferably, the pushing end 22 is formed as the shape of battlements, so that the pushing end 22 has many convex portions and concave portions. And each elastic member 30 is disposed on one of the convex portions. In other possible embodiments of this present invention, the quantity of the elastic member can be one or more than two pieces, and the elastic member abuts against the middle part of the supporting member 20. Further, to prevent the supporting member 20 from departing from the positioning slot 13, the supporting member 20 can have a stopping portion 24 which is near the second surface. The stopping portion is located outside of the positioning slot 13. Thereby, when the supporting member 20 is located in the first position, the stopping portion 24 pushes the guiding panel 10 so as to limit the supporting member 20, so that the supporting member 20 is avoided from completely departing from the first surface 11 of the positioning slot 13.

Figure 9:
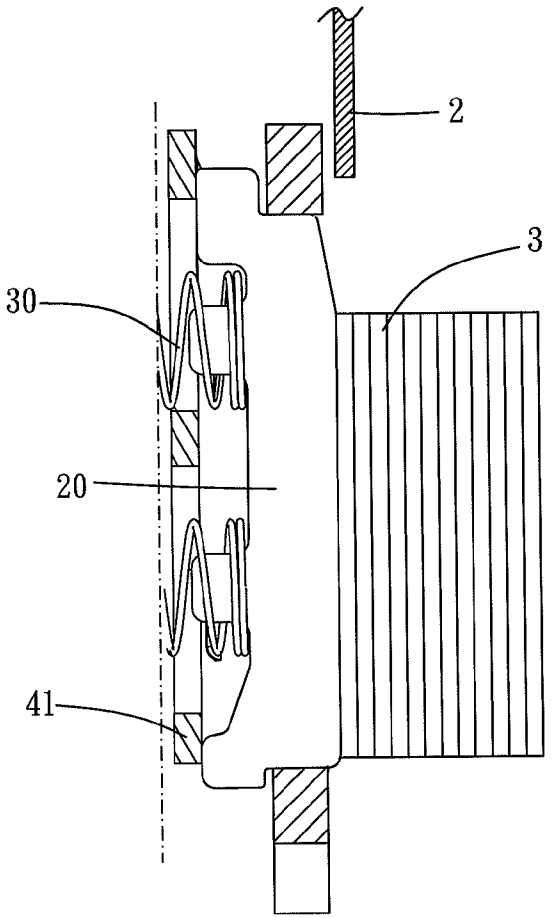

The holding means is adapted to selectively hold the supporting member 20, so that the supporting member 20 cannot move to the second position. Preferably, when the holding means holds the supporting member 20, the supporting member 20 only can move from the first position to the third position which is between the first and the second position, as shown in FIG. 9. More specifically, the holding means includes a holding member 41, and the holding means can further comprise a flip plate 42 and a connecting plate 43.

The holding member 41 is slidable between a holding position and an open position. The holding member 41 faces the second surface 12 and holds the supporting member 20 so as to stop the supporting member 20 from moving to the second position when the holding member 41 is located in the holding position. The holding member 41 is departed from the supporting member 20 when the holding member 41 is located in an open position, so that the supporting member 20 can slide between the first position and the second position. Preferably, the holding member 41 holds one of the convex portions on the pushing end 22 of the supporting member 20. The holding member 41 can be formed with a through hole 411 slightly larger than the elastic member 30, so that the holding member 41 does not push the pushing means or the elastic member 30 while moving.

The flip plate 42 is adapted to slidably be disposed on a shell surface of the nail gun for a user to flip. The flip plate 42 links up with the connecting plate 43, and the connecting plate 43 further links up with the holding member 41. To be specific, the connecting plate 43 is formed with a convex post 431. The holding member 41 is correspondingly formed with a notch 412. The convex post 431 abuts against the notch 412, so that the connecting plate 43 brings the holding member 41 to move. Thereby, when the flip plate 42 moves, the flip plate 42 brings the connecting plate 43 to move, and the connecting plate 43 further brings the holding member 41 to move between a holding position and an open position. Preferably, the length of the notch 412 is larger than the convex post 431, so that the flip plate 42 will move a distance to abut against the notch, and then bring the holding member 41 to move. In other possible embodiments of the present invention, the holding member 41 can directly extend and protrude out of a shell surface of the nail gun, so that a user can directly flip the holding member 41 to move. Or, the flip plate 42 can directly link up with the holding member 41, so that the flip plate 42 can be moved to bring the holding member 41 to move between the holding position and the open position.

The nail guiding structure of the present invention can be disposed inside of the nail gun. In addition to the nail guiding structure, the nail gun further includes said nail rail, a punching board 2, and a shell 1. The above-mentioned components are disposed inside of the shell 1. And the flip plate 42 is slidably disposed on a surface of the shell. The nail rail is adapted to support nails to slide along an extending direction of the nail rail, and the punching board 2 is adapted to selectively punch the nails out.

Please refer to FIGS. 5 to 9. The nail guiding structure of the present invention is available for different sizes of U-shaped nail. Please further refer to the FIGS. 5 and 6, when the punching board 2 moves outside of the nail guiding structure, the supporting member 20 is pushed to move to the first position by the pushing means, and the holding member 41 can be moved to the open position. Please refer to the FIGS. 7 and 8, when the nails 3 are placed in the guiding groove 14, the nails 3 can push the supporting member 20 to the second position, so that the nail 3 can be smoothly disposed in the guiding groove 14, and the nails 3 can be punched out with the punching board 2. Please refer to FIG. 9, when the nail gun is loaded with thinner nails, the holding member 41 can be moved to the holding position, so that the holding member 41 holds the supporting member 20. When the thinner nails 3 are placed in the guiding groove 14, because the supporting member 20 cannot move to the second position, the supporting member 20 can push the nails 3 and make only one nail to be disposed in the guiding groove 14 for each time the punching board punching. Thereby, only one nail will be punched in each punching movement, so that it can prevent too many nails 3 from being disposed in the guiding groove 14, and even the thinner nails can be punched out normally.

Figure 10:
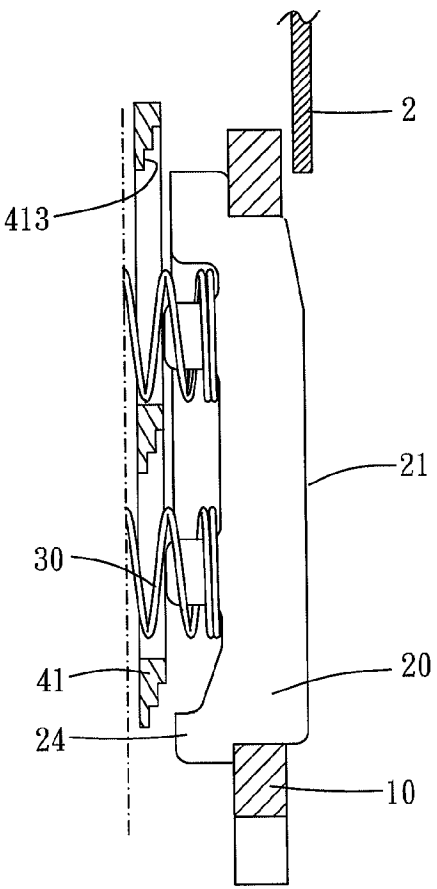

Please refer to FIG. 10. In another embodiment of the present invention, the holding member 41 can also be formed with plural abutting surfaces 413. The abutting surfaces 413 are formed in a step-like shape, so that the holding member 41 can be moved to different positions. When the holding member 41 is located in the holding position, the holding member 41 can abut against the supporting member 20 with its abutting surfaces of different positions, so that the supporting member can correspond to different thicknesses of nails.

Besides, the supporting member of the present invention can be pushed by nails. When a user wants to load T-shaped nails or other shaped nails into a nail gun comprising the nail guiding structure, the user only needs to fill those nails into the nail gun directly before using. The supporting member pushes the sides of those nails and makes those nails ready to be punched out without further switching the holding means or the flip plate.

Figure 11:
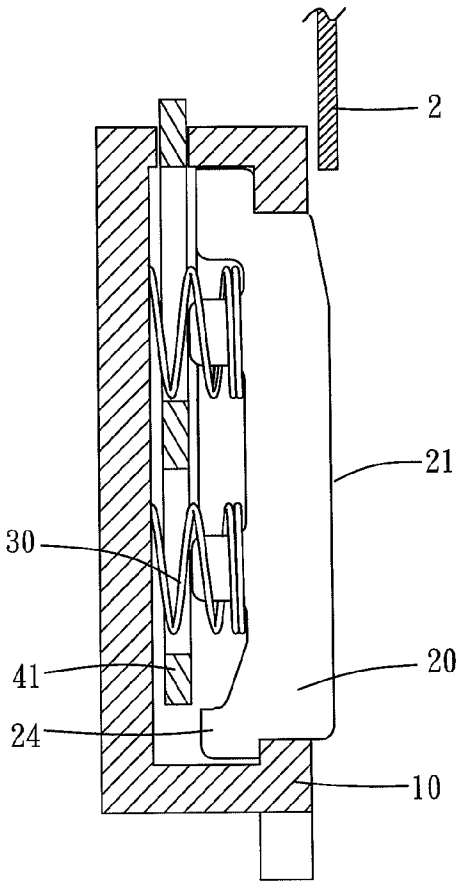
FIGS. 10-12 are sectional drawings showing another preferred embodiment of a nail guiding structure in accordance with the present invention.

Please refer to FIG. 11, in other possible embodiments of the present invention, the positioning slot can be concavely formed and without passing through the second surface, so that the elastic member 30 can be directly disposed in the positioning slot, and the elastic member 30 can push the supporting member to the first position.

Figure 12:
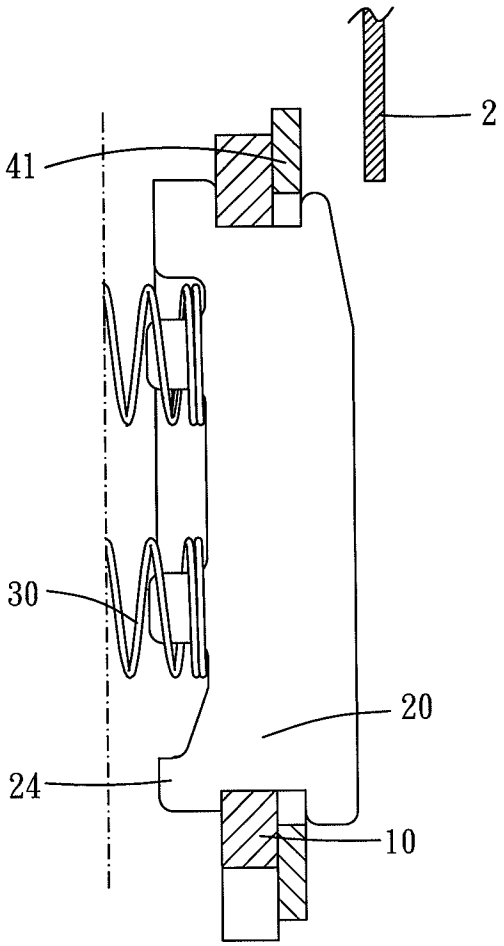

Please refer to FIG. 12, the present invention can further changes the position of the holding member so as to make the holding member disposed near one side of the first surface. In this way, the holding member still can hold the supporting member and provide the same effect as the previous embodiments.

Accordingly, the present invention mainly uses the holding member to hold the supporting member so as to allow users to load nails with different thicknesses. In addition, the supporting member also adapts for different shapes of nails like T-shaped nails, U-shaped nails, and so on. Thereby, the present invention is available for different thicknesses and shapes of nails.

What is claimed is:

1. A nail guiding structure for being disposed inside of a nail gun having a nail rail, the nail guiding structure being adapted to be disposed in front of the nail rail comprising:

a guiding panel, being vertically disposed in front of the nail rail, the guiding panel having a first surface and a second surface opposite to the first surface, the first surface facing toward the nail rail, the guiding panel being formed with at least one positioning slot, the positioning slot being concavely formed on the first surface;

at least one supporting member, corresponding to the positioning slot, the supporting member being slidably disposed in the positioning slot, so that the supporting member can slide between a first position and a second position, the supporting member having a supporting end and a pushing end, the supporting end protruding out of the first surface when the supporting member is located in the first position, the supporting end approaching the first surface when the supporting member moving toward the second position;

at least one pushing means, adapted to elastically push the pushing end, so that the supporting member has a tendency to move to the first position;

at least one holding means, adapted to selectively hold the supporting member, so that the supporting member is prevented from moving to the second position.

2. The nail guiding structure of claim 1, wherein the supporting member further comprises a supporting surface, the supporting surface is parallel to an extending direction of the nail rail, and the supporting surface is adapted to stabilize nails in the nail gun.

3. The nail guiding structure of claim 1, wherein the pushing means comprises at least one elastic member corresponding to the supporting member, the elastic member pushes the supporting member.

4. The nail guiding structure of claim 1, wherein the supporting member has a stopping portion which is near the second surface, the stopping portion is located outside of the positioning slot, the stopping portion pushes the guiding panel when the supporting member is located in the first position, so that the supporting member is prevented from completely departing from the positioning slot.

5. The nail guiding structure of claim 1, wherein the first surface of the guiding panel is formed with a guiding groove which extends vertically, and the guiding groove is adapted to guide a punching board or a nail to slide linearly along the guiding groove.

6. The nail guiding structure of claim 1, wherein the holding means comprises a holding member, the holding member is slidable between a holding position and an open position, the holding member holds the supporting member so as to prevent the supporting member from moving to the second position when the holding member is located in the holding position, the holding member is departed from the supporting member when the holding member is located in the open position, so that the supporting member can slide between the first position and the second position.

7. The nail guiding structure of claim 6, wherein the holding means further comprises a flip plate and a connecting plate, the flip plate is adapted to be slidably disposed on a shell surface of the nail gun, the flip plate links with the connecting plate, the connecting plate links with the holding member, so that when the flip plate moves, the flip plate allows the connecting plate to move, and the connecting plate further allows the holding member to move between the holding position and the open position.

8. The nail guiding structure of claim 7, wherein the holding member is formed with plural abutting surfaces, the abutting surfaces are formed in a step-like shape, one of the abutting surfaces holds the supporting member when the holding member is located in the holding position.

9. The nail guiding structure of claim 6, wherein the holding member extends to protrude out of a shell surface of the nail gun, so that the holding member can be operated directly to move between the holding position and the open position.

10. The nail guiding structure of claim 6, wherein the holding means further comprises a flip plate, the flip plate is adapted to be slidably disposed on a shell surface of the nail gun, the flip plate links with the holding member, the flip plate allows the holding member to move between the holding position and the open position when the flip plate moves.

11. The nail guiding structure of claim 6, wherein the holding member is formed with plural abutting surfaces, the abutting surfaces are formed in a step-like shape, one of the abutting surfaces holds the supporting member when the holding member is located in the holding position.

12. A nail gun, comprising a nail guiding structure disposed inside the nail gun, the nail guiding structure being adapted to be disposed in front of a nail rail and comprising a guiding panel, being vertically disposed in front of the nail rail, the guiding panel having a first surface and a second surface opposite to the first surface, the first surface facing toward the nail rail, the guiding panel being formed with at least one positioning slot, the positioning slot being concavely formed on the first surface; at least one supporting member, corresponding to the positioning slot, the supporting member being slidably disposed in the positioning slot, so that the supporting member can slide between a first position and a second position, the supporting member having a supporting end and a pushing end, the supporting end protruding out of the first surface when the supporting member is located in the first position, the supporting end approaching the first surface when the supporting member moving toward the second position; at least one pushing means, adapted to elastically push the pushing end, so that the supporting member has a tendency to move to the first position; at least one holding means, adapted to selectively hold the supporting member, so that the supporting member is prevented from moving to the second position, further comprising:

a nail rail;

a punching board;

a shell, wherein the nail guiding structure, the nail rail, and the punching board is disposed inside of the shell, the nail rail is adapted to support nails to slide along an extending direction of the nail rail, and the punching board is adapted to selectively punch the nails out.

* * * * *